United States Patent [19]

Novotny

[11] Patent Number: 5,021,202

[45] Date of Patent: Jun. 4, 1991

[54] METHOD AND APPARATUS FOR CONSTRUCTING RAMMED EARTH WALLS WITH INTEGRAL CEMENT JACKETS

[76] Inventor: Jan Novotny, 18 St. Austell Road, Belgrave South, Victoria, Australia, 3160

[21] Appl. No.: 397,418

[22] PCT Filed: Jan. 29, 1988

[86] PCT No.: PCT/AU88/00025

§ 371 Date: Jul. 27, 1989

§ 102(e) Date: Jul. 27, 1989

[87] PCT Pub. No.: WO88/05849

PCT Pub. Date: Aug. 11, 1988

[30] Foreign Application Priority Data

Feb. 2, 1987 [AU] Australia ..... PI0146

[51] Int. Cl.[5] ..... B28B 1/08; B28B 13/00; E04B 1/16; E04G 11/18

[52] U.S. Cl. ..... 264/33; 249/20; 249/36; 264/34; 264/35; 264/69; 264/256; 425/62; 425/64; 425/87; 425/130; 425/257; 425/262

[58] Field of Search ..... 249/20, 36; 425/62, 425/64, 130, 87, 257, 262, 426, 427, 447; 264/31-35, 69, 71, 256

[56] References Cited

U.S. PATENT DOCUMENTS

| | | | |
|---|---|---|---|
| 512,431 | 1/1894 | Chatain et al. | 264/256 |
| 836,369 | 11/1906 | Dexter | 249/20 |
| 916,084 | 3/1909 | Witthoeff | 249/20 |
| 972,036 | 10/1910 | Sullivan | 264/34 |
| 1,208,398 | 12/1916 | Stoeser | 425/64 X |
| 1,244,608 | 10/1917 | Hicks | 264/256 X |
| 1,457,090 | 5/1923 | Sellman | 425/64 |
| 1,475,570 | 11/1923 | Dye . | |
| 1,629,103 | 5/1927 | Honberger | 264/256 X |
| 1,776,438 | 9/1930 | Kinninger | 264/277 X |
| 2,496,616 | 2/1950 | Barton | 264/34 |

FOREIGN PATENT DOCUMENTS

| | | | |
|---|---|---|---|
| 72506 | 2/1983 | European Pat. Off. | 425/262 |
| 550284 | 3/1977 | U.S.S.R. | 425/130 |
| 609633 | 6/1978 | U.S.S.R. | 425/130 |

*Primary Examiner*—Jan H. Silbaugh
*Assistant Examiner*—Karen D. Kutach
*Attorney, Agent, or Firm*—Marion P. Lelong

[57] ABSTRACT

Rammed building walls having an earth core and integral cement jackets are formed by placing a rectangular earth hopper within a rectangular wall moulding cavity that is defined by formwork members which are aligned with an underlying foundation. The hopper is filled with earth while outside of the moulding cavity and has a trapdoor as its bottom. The moulding cavity has a substantially greater width than the width of the hopper so that jacket cavities are formed on either side of the hopper. A pair of tiltable cement hoppers, filled with concrete or a sand and cement mix, are mounted on the earth hopper and are tiltably unloaded into the jacket cavities. The trapdoor is then released so that the earth slides downwardly and laterally, and the hoppers are lifted as a unit out of the moulding cavity while the earth fills a core cavity between the mix-filled jacket cavities. Both the earth and mix are then rammed simultaneously.

20 Claims, 3 Drawing Sheets

FIG. 3
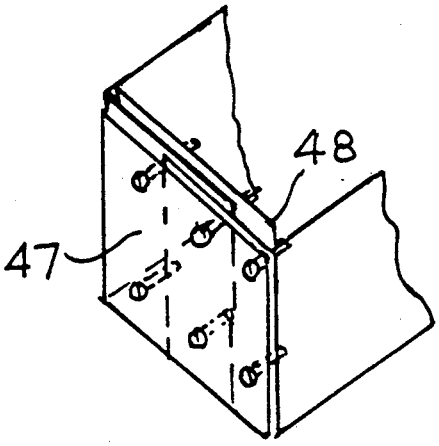
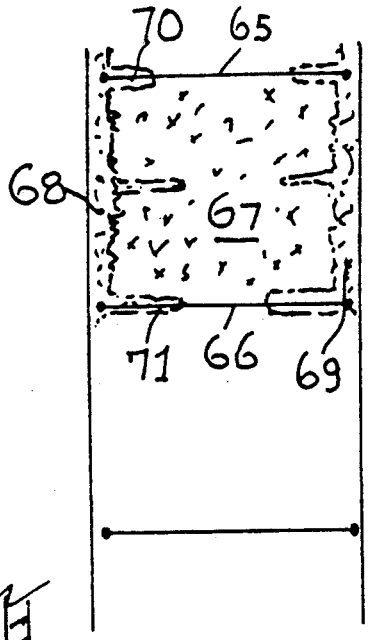
FIG. 5
FIG. 4
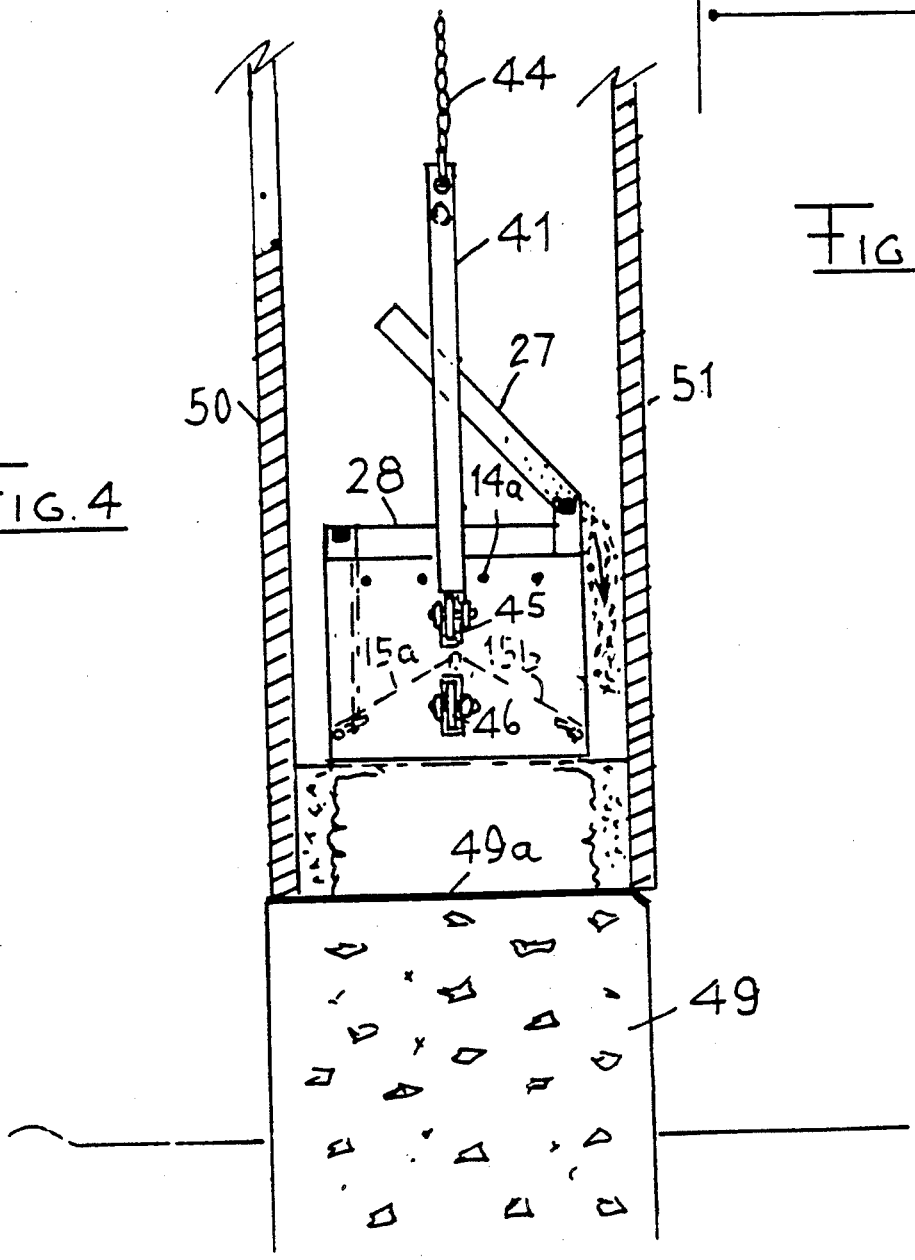

55
56
57
54
61
59
60
62
50
58
58
63
64

METHOD AND APPARATUS FOR CONSTRUCTING RAMMED EARTH WALLS WITH INTEGRAL CEMENT JACKETS

This invention relates generally to methods of building construction using materials, such as mud bricks, earth, soil and the like and unskilled labour amd more specifically is concerned with the construction of walls for homes by owners using loose earth, taken from owner builder sites, or elsewhere and then rammed.

The invention, according to one broad concept, resides in apparatus for forming rammed earth walls for building structures which includes two side and two stop end wood plank or board formwork members, placed in parallel spaced relationship and clamped together to form a wall moulding cavity for rammed earth, placed within the cavity, a bucket or the like for filling with rammed earth and lift means for lifting the earth-laden bucket up to the level of formwork members and a ram for ramming the earth into the moulding cavity characterized in that: a wall spacer member is provided at a distance from the inner surface of at least one formwork member which is less than the total width between opposite formwork members to form a central core cavity for rammed earth and one or two outer jacket cavities for moist, powdered cement mix, the mix being rammed as an outer layer or layers of facing or veneer jacket simultaneously with earth rammed in the inner or central cavity, whereby the mix veneer becomes an integral moulded jacket with the rammed earth wall. Preferably, two spacers are used to form a central moulding cavity for a rammed earth core and two other cavities for outer layers of rammed powdered mix or veneer material, the total width of the two outer jacket cavities being less than the width of the central core cavity, the height of the spacers being equal and enabling the height of the mix or veneer jacket to be equal to, or greater than the height of earth rammed in the central moulding cavity and more preferably, there are two spacers formed into the side walls of a box-like container which functions as an earth hopper having side walls and end walls with lateral dimensions less than those of formwork, the earth hopper container having an open top with a screening grid and a closable bottom or floor and is adapted to be level-filled with loose earth with the bottom closed and with the container resting upon the foundation footings, or upon a layer of previously rammed earth veneered with cement mix in formwork in a wall structure a pair of rectangular, flat, three-walled trays is adapted to be placed upon the loose-earth filled container and the trays level-filled with a moist powder, cement mix, the trays are tipped in opposite mutual directions into cavities between the formwork panels and the side walls of the container, until the level of cement mix is slightly above that of the earth, the bottom of the tray preferably comprises dual trapdoor segments, opened manually by lift and drop rods fastened by brackets and the container has hoist attachment lift means thereon for lifting up the container allowing earth to fall out and fill the core cavity between the loose cement mix material, both cement mix and earth then being rammed into an integral mass after the container is lifted out of the way.

According to one form of the earth hopper which may be preferred, the openable bottom thereof comprises a dual segment trapdoor, centrally hinged at a distance above the level of the bottom of the hopper walls and inclined at an angle to the horizontal and vertical, when in a fully closed position and when in a partially open position.

The invention, according to another broad concept resides in a method for constructing integral rammed earth and cement mix walls for buildings, homes and the like which comprises placing side wall and stop end vertical timber formwork members upon a wall foundation and in parallel arrangement to form a wall moulding cavity for filling with loose earth, reducing the width of the cavity by placing a wall spacer member or members therein at a distance from the inner surface of at least one formwork member to form a core cavity for rammed earth and one or two jacket cavities for cement mix, progressively filling and ramming the inner cavity with earth fill material while simultaneously filling and ramming at least one jacket cavity with damp particulate veneer or facing mix material to provide a smooth aesthetically acceptable and weather-sealing, external or internal, or both external and internal facing or veneer finish to the exposed surfaces of the rammed earth wall unit.

More particularly and preferably, each spacer is formed as an open-top, straight-walled, square or rectangular hopper container serving as a earth hopper with walls which are of lesser lateral dimension than formworks, an openable bottom or floor which is, when closed, adapted to be filled up with earth then lifted up above the formwork and then lowered into the wall cavity for bottom discharge into the central wall cavity, the side cavity or cavities being filled with moist powdered cement mix material, both earth and mix being compressed while being rammed into the cavities, the cement mix preferably being carried on top of the earth hopper in trays which are tiltable with respect to the hopper/skip, the mix being transferable from the trays into the side cavities alongside the earth and adapted to be rammed simultaneously with the earth.

The advantages of the rammed earth walls with integral rammed mix of the invention are that the mix is easier and quicker to apply without requirement for skilled labour and the finished mix surface is smooth enough to receive wall paper on internal walls, or paint directly without prior preparation and sealing and is also high enough in density to eliminate the need for sealing against the weather. Advantageously, it is possible to use a wide variety of earth and soil types and since the mix can be wedged into the wall earth structure, it is less likely to separate as with conventional render. The integral rammed mix is applied in a semi-dry low moisture content state and is stronger and denser than conventional render which is applied in a wet slurry and is weaker amd more porous after curing.

A non-limitative example of a practical arrangement of the invention will now be described with reference to the accompanying drawings in which:

FIG. 3 is a scrap perspective of earth hopper having an optional, variable width arrangement.

FIG. 4 is a schematic end view, similar to FIG. 2.

FIG. 5 is a partial, typical, vertical crosssection through a wall constructed in accordance with the invention.

Figure 1:
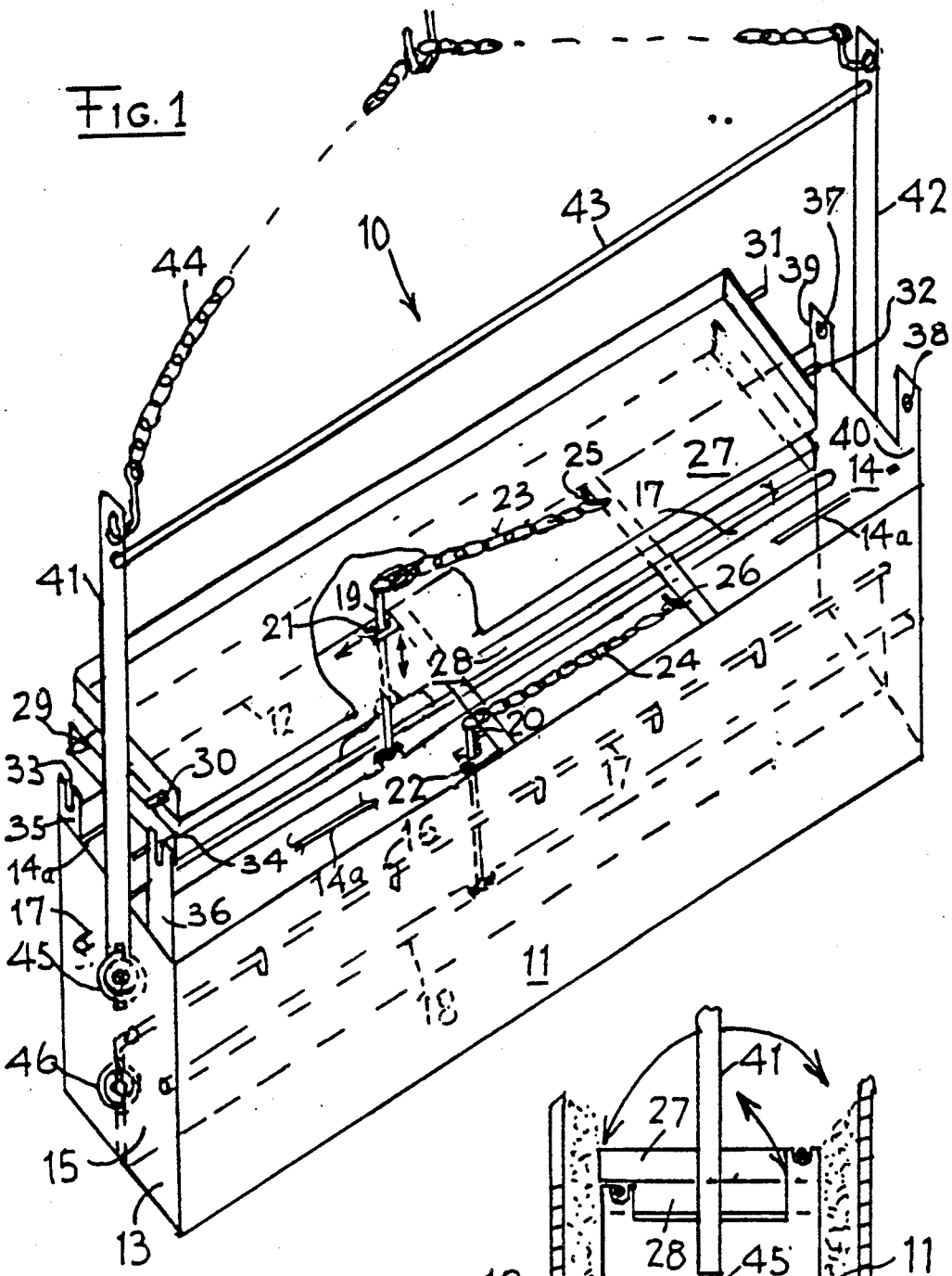
FIG. 1 is a perspective view of a rammed earth wall forming and cement mix facing earth hopper apparatus, constructed in accordance with the invention.

Referring to the drawings, there is shown in FIG. 1, apparatus for progressively applying a structurally strengthening, aesthetic and protective facing of cement mix simultaneously on both inner or outer wall surfaces of a rammed earth building wall structure, the apparatus comprising an earth hopper 10, adapted to be level-filled with moist earth preferably of 10% moisture content—an ideal soil being about 60% sand and 40% clay. Organic top soil matter is unsuitable and must not be used for rammed earth wall construction. The earth hopper is preferably in the form of an elongate metal box with side walls 11, 12, end walls 13, 14 and with an open top having a grid 14*a* and a bottom which is openable and closable by a trapdoor 15, split into two longitudinal segments 15*a*, 15*b*, (shown in fully open, earth dropping, vertical position in FIG. 1), the top or inner edges thereof being hingedly mounted along the trapdoor support bar 16 which in turn is mounted along the longitudinal centre line of the earth hopper at a vertical distance above the bottom line.

In FIG. 4, the trapdoor segments 15*a*, 15*b* are shown in an inclined, fully closed, earth-retaining position, the radial distance or width of the trapdoor segments being such as to allow the segments to partially drop down in contact with the top surface of a foundation layer or previously rammed layer to allow loose earth to fall and form starting side portions of earth. The trapdoor segments 15*a*, 15*b* are also designed to be retained in an inclined, fully closed position by means of tilting cam bars 17, 18, pivotally mounted upon and extending longitudinally along the inside of the side walls at a distance from the bottom edges thereof. The cam bars 17, 18 are retained in lifted up position underneath the outer edges of the trapdoors by means of the rods 19, 20, the lower ends of the rods being pivotally attached to the cam bars while the upper ends each have a bolt head adapted to be placed over the slotted retainer brackets 21, 22. The rods are movable both laterally and vertically, as shown by the arrows and each has a retaining chain 23, 24, the end link of each chain being adapted to be retained upon a retaining spike 25, 26. Two three-sided, tiltable trays 27, 28 are adapted to be level-filled with moist (5% to 15% and preferably 10% water), powdered cement mixture (1:5 cement/sand ratio) by placing the trays in juxtaposition upon the ground with open (non-walled) sides facing in abutment andthen level-filling the trays which are then stacked upon the earth hopper, each tray has two pivot pins 29, 30, 31, 32, protruding from each end thereof, the pins being adapted to be placed respectively into grooves 33, 34 of brackets 35, 36, or holes 37, 38 of brackets 39, 40 at each end of the earth hopper. The brackets of one side are of different height than those of the other side to enable the stacked trays to be tilted successively, each in a vertical arc in an opposite direction to transfer loose, moist powdered cement mix from each tray into a separate jacket cavity, approximately 30 mm wide, as shown in FIG. 4 of the drawings.

The earth hopper has two vertical lift support bars 1, 42, upstanding therefrom with a cross bar 43 extending therebetween. At the top of each suspension bar, there is provided a hole for attachment of hooks of the lifting chain (or cable) 44, for lifting by a hoist (or a block and tackle)—described later with reference to FIG. 6 of the drawings. There is provided on each end wall of the earth hopper 10, two pairs of freely rotatable guide members or wheels, such as the two shown 45, 46 and these wheels are adapted to help guide and maintain the earth hopper in a horizontal position within a cavity between already formed walls and formwork as shown in FIG. 6.

Referring to FIG. 3, there is shown an end wall structure of the earth hopper which is 240 mm in height, whereby the width may be varied from 240 to 290 mm in accordance with different wall thickness requirements. In a similar manner, the length may also be varied from 1200 mm to 1900 mm. In the arrangement shown in FIG. 3, each side wall panel is turned at right angles to form overlapping end wall panels and inner and outer full height and width strengthening/joining panel 47, 48 are bolted over the turned-in end wall segments.

Figure 2:
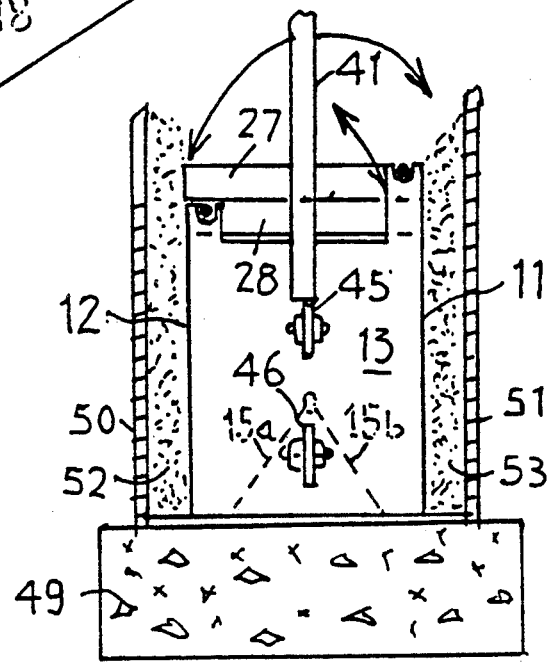
FIG. 2 is an end elevation of the apparatus of FIG. 1 in situ between formwork and on foundation footings for a rammed earth wall shown in vertical crosssection.

Refering to FIGS. 2, 4 and 5 which illustrate the method of constructing an integral rammed earth and cement mix wall structure, there is shown in FIG. 2, the earth hopper 10 of the invention, level-filled with earth together with the two stacked trays 27, 28, thereupon level-filled with powdered cement mix (cement/sand mix of 10% moisture content) are lowered into the wall cavity, placed upon concrete footings 49 (FIG. 2, or rammed earth FIG. 4) and between plywood formwork members 50, 51. Damp course 49a is preferably included as in FIG. 4. Each tray is tilted in a single, mutually opposite direction to onload moist cement of mix powder into wall outer jacket cavities 52, 53. At this stage with the loose cement mix in position, the trapdoor segments are allowed to drop down by loosening the chains and also the cam rods 19, 20 by hand from the brackets into a partially inclined, initial unloading postion to allow some earth to fall downwards and initially outwards, towards the jacket cavities while still retained by the sidewalls of the earth hopper.

Figure 6:
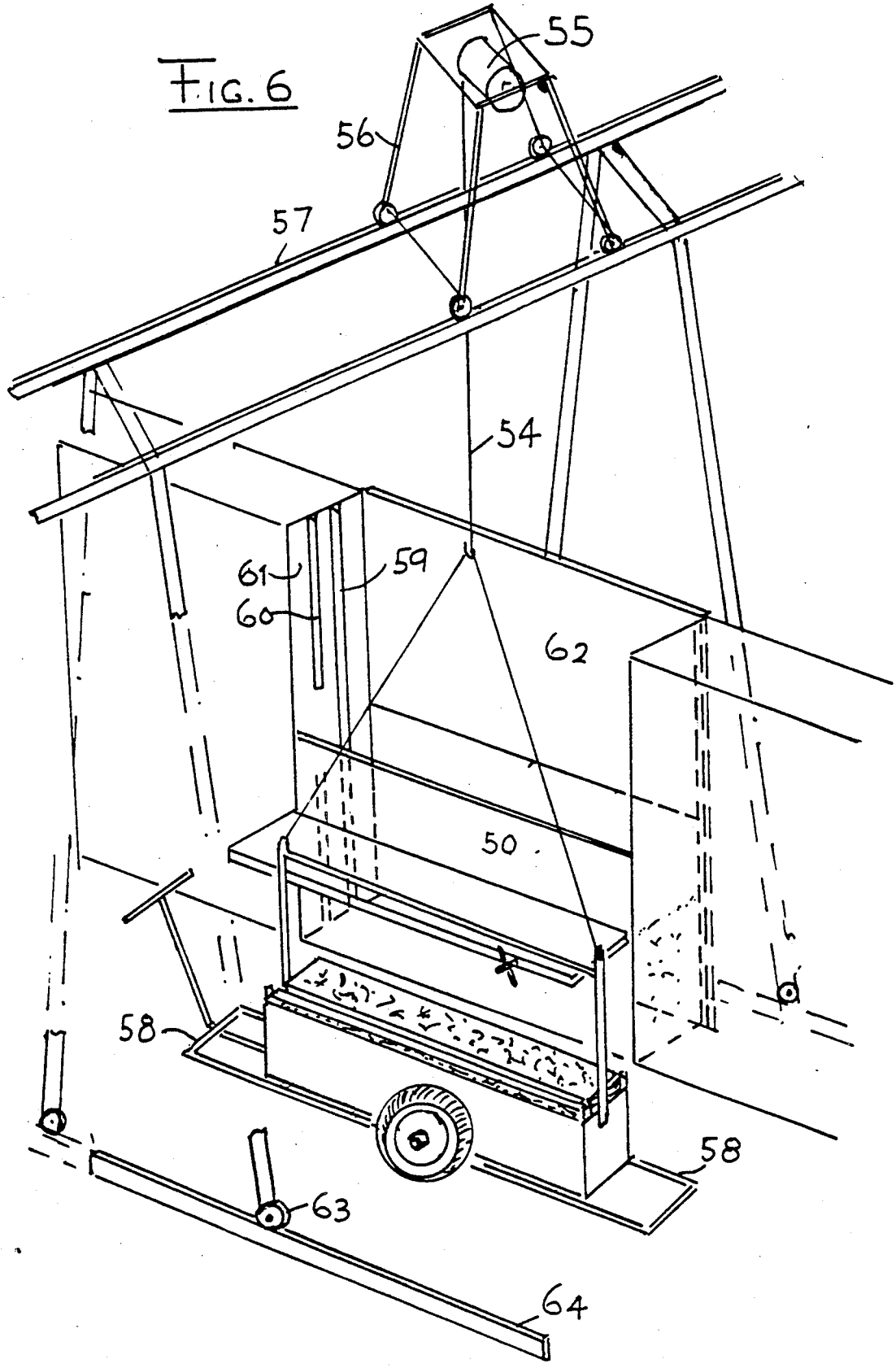
FIG. 6 is a perspective view of apparatus of the invention on a building site.

Referring to FIG. 6, the earth hopper is then raised by the hoist chain or cable 54 by operating the hoist 55 (or block and tackle) whereupon the trapdoor segments drop to a vertical, fully-open position to release the remainder of the loose earth from the earth hopper after which the earth hopper carrying the trays is lowered to the ground outside of the formwork and onto the rubber-tyred, wheeled, hand trolley. Both the outer layers of cement mix powder and the earth are compacted togetherby ramming either manually or mechanically to form an integral, continuous 350 mm thick wall. Vertical wall conduit cavities comprising continuous cavity 59 and interrupted cavities 60 are formed in the end face 61 of wall sections by angle-iron inserts in formwork stop ends. These cavities can be used for keying adjacent panels. Anchorages can also be embedded in wall structures.

The formwork shown in FIG. 6 comprises a full height rear panel 62 formed in two sections, the front being formed of stacked single layer sections for access, such as that designated 50.

It will be appreciated that, instead of using the trays, the cement mix can be poured into the outer cavities by pumping with a hose, or by mechanical shovels or the like.

After each wall is completed, the whole gantry is moved to the next wall section to be constructed by means of wheels 63 on tracks 64.

A preferred method of constructing the wall is shown in FIG. 5 of the drawings which shows a section of rammed earth wall, including steel or wire mesh, such as chicken wire reinforcement and wall ties 65, 66, placed between alternate layers of a rammed earth core 67 and outer integral rammed, moist, powdered cement mix jacket or facings 68, 69. It will be noted that there are protrusions of mix, such as those designated 70, 71 into the rammed earth. This effect creates improved bonding between render and earth and is achieved by having the height of the mix above the height of the earth, when the mix is poured from the trays into the cavity between formwork and the hopper/skip.

I claim:

1. Apparatus for forming rammed earth walls having a core of rammed earth and an integral jacket of rammed, moist powdered sand and cement mix or concrete for building structures, comprising:

A. a plurality of side and end formwork members which are successively placed vertically upwardly and in parallel spaced relationship and clamped together to form a rectangular wall moulding cavity;

B. an earth hopper for level filling with loose earth uppn the ground while outside of said moulding cavity, said hopper having:

(1) two side walls and two end walls forming an open top and a closable bottm, said hopper walls defining a rectangular central core cavity when said earth hopper is lowered into said moulding cavity and the width of said end walls being substantially less than the width of said moulding cavity so as to form, on either side of said earth hopper, a pair of outer jacket cavities, (2) as said bottom, a trapdoor for discharging said loose earth into said central core cavity, and (3) means for selectively releasing said trapdoor;

C. two cement hoppers which are pivotally mounted on said earth hopper for level filling with a loose, moist sand and cement mix while said cement hoppers are outside of said moulding cavity;

D. means for tiltably unloading said mix into said jacket cavities, said earth and cement hoppers forming a hopper unit for simultaneously carrying and then successively unloading first said loose cement mix into said jacket cavities and next said loose earth into said central core cavity;

E. a lifting means which is attached to said earth hopper for lifting and lowering said unit; and F. a means for ramming said earth and said cement mix in said moulding cavity.

2. Apparatus as defined in claim 1, wherein said earth hopper is of extendible width, said end walls being formed as right-angled, sleeved sections.

3. Apparatus as defined in claim 1, wherein said earth hopper incorporates a screening grid along said open top thereof.

4. Apparatus as defined in claim 1 which includes a wheeled hand trolley of rectangular form for transporting said hopper unit along said ground at a buildling site.

5. Apparatus as defined in claim 1, wherein said lifting means includes a hoist.

6. Apparatus as defined in claim 5, wherein said hoist is mounted on a hoist gantry mounted on wheels adapted to run on tracks.

7. Apparatus as defined in claim 1, wherein said cement hoppers comprise a pair of flat, rectangular, three-walled trays having end walls and a single side wall, each said tray having lateral dimensions substantially equal to those of said earth hopper, said trays being adapted to be placed in a mutually stacked loading position upon said earth hopper and being adapted to be filled with said sand and cement mix while outside of said formwork members and after said earth hopper has been level filled with said loose earth.

8. Apparatus as defined in claim 7, wherein each said tray is pivotally attached by at least one hinge which is attached to said single side wall of saidt ray and to a top edge of said earth hopper, each said tray being tiltable in a vertical arc in mutually opposite directions with respect to the other tray in order to empty said loose sand and cement mix into said jacket cavities.

9. Apparatus as defined in claim 1, wherein said earth hopper includes at least one hopper guide member projecting from each said end walls therof.

10. Apparatus as defined in claim 9, wherein there are four said guide members for said earth hopper.

11. Apparatus as defined in claim 10, wherein said guide members are each in teh form of freely rotatable wheels.

12. Apparatus as defined in claim 10, wherein said end formwork members have angle-iron inserts which form vertical wall conduit cavities comprising a continuous cavity and interrupted cavities for keying adjacent panels.

13. Apparatus as defined in claim 1, wherein each earth hopper is formed as an open rectangular box and said trapdoor is formed into two longitudinal segments having inner and outer side edges, said segments being pivotally mounted at said inner side edges on a trapdoor support bar which is mounted along the longitudinal center line and above the base line of said side walls of said earth hopper, said segments being able to partially swivel down at an inclined angle when released, with said outer edges in contact with the top surface of a foundation layer of a previously rammed core and jacket to allow portions of said loose earth to fall downwardly and outwardly toward said jacket cavities while still retained by said side walls of said earth hopper.

14. Apparatus as defined in claim 13, wherein said trapdoor segments are retained in fully closed position while inclined to the horizontal by means of tilting cam members mounted upon and extending longitudinally along the inside, and above the bottom edges of, said side walls of said earth hopper.

15. Apparatus as defined in claim 14, wherein said cam members are retained in lifted-up position by means of moveable lift members having lower ends which are pivotally attached to said cam members and having upper ends with widened ends which are removably placed within slots of fixed retainer brackets.

16. Apparatus as defined in claim 15, wherein said moveable lift members are rods, the upper end of each said rod being retained in one of said retainer brackets by a chain having one end permanently fixed to said upper end of said rod, the other end of said chain being free and removably fastened to a spike fixed upon a screening grid on top of said earth hopper.

17. Apparatus as defined in claim 16, wherein said earth hopper has a pair of vertical suspension bars which are fixed to said ends thereof and connected by a cross bar, said suspension bars extending vertically upwards for a distance sufficient to enable said cement hoppers to be swung up and down with respect to said earth hopper during loading and unloading of said earth and cement hoppers.

18. A method for constructing rammed earth ealls with integral rammed sand and cement mix jackest for buildings which comprises:

A. placing side and end wall formwork members upon a wall foundation and in parallel arrangement to form a rectangular wall moulding cavity;

B. outside of said formwork members, level filling with loose earth an earth hopper comprising a rectangular container having:

(1) side and end walls, (2) a lateral dimension which is substantially less than the internal width of said moulding cavity, and (3) a bottom trapdoor;

C. lifting said filled earth hopper over said formwork members;

D. lowering said hopper into said moulding cavity and onto said foundation, said hopper being equally laterally spaced from said formwork members to define a central core cavity within said moulding cavity and a pair of jacket cavities straddling said moulding cavity;

E. filling said jacket cavities with a loose, moist sand and cement mix;

F. opening said trapdoor so that portions of said loose earth fall downwardly into said core cavity and initially outwarldy toward and against the side walls of said container;

G. raising said hopper out of said moulding cavity while the remainder of said loose earth falls into said core cavity;

H. simultaneously ramming said loose earth and said loose mix to obtain a bottom layer of integrated rammed earth and rammed sand and cement mix as an earth core and integral cement jackets, respectively; and I. successively repeating steps B through H to obtain additional layers upon and attached to said bottom layer until a selected wall height is reached.

19. The method defined in claim 18, wherein, outside of said formwork members, two cement hoppers, in the form of tiltable trays which are hingedly mounted upon said earth hopper, are level filled with said sand and cement mix, are transported as a unit with said earth hopper into said moulding cavity, are selectively tilted in opposite directions into said jacket cavities for filling said jacket cavities with said loose mix as said step E, and are lifted as a unit with said earth hopper out of said moulding cavity.

20. The method defined in claim 18, wherein said loose mix is poured into said jacket cavitities up to a height which is greater than the level of said loose earth in said core cavity so that said mix is partly folded over onto said earth to form binding protrusions into said earth when said earth and said mix are rammed.

* * * * *